US005206691A

United States Patent [19]

Mizuno et al.

[11] Patent Number: 5,206,691

[45] Date of Patent: Apr. 27, 1993

[54] DEVELOPING APPARATUS

[75] Inventors: Hiroshi Mizuno, Ikoma; Toshiya Natsuhara, Nishinomiya; Satoshi Deishi, Amagasaki; Toshimitsu Fujiwara, Kobe, all of Japan

[73] Assignee: Minolta Camera Kabushiki Kaisha, Osaka, Japan

[21] Appl. No.: 828,300

[22] Filed: Jan. 30, 1992

[30] Foreign Application Priority Data

Feb. 1, 1991 [JP] Japan ..... 3-011926

[51] Int. Cl.[5] ..... G03G 15/08

[52] U.S. Cl. ..... 355/259; 118/653; 355/245

[58] Field of Search ..... 355/245, 253, 259; 118/653, 661

[56] References Cited

U.S. PATENT DOCUMENTS 4,337,724 7/1982 Hosono et al. ..... 118/657 X
4,791,882 12/1988 Enoguchi et al. ..... 118/653
4,883,017 11/1989 Yuji et al. ..... 118/653
4,907,032 3/1990 Enoguchi et al. ..... 355/253
4,987,454 1/1991 Natsuhara et al. ..... 355/259

FOREIGN PATENT DOCUMENTS 62-62858 3/1987 Japan .
62-218445 9/1987 Japan .
63-241063 10/1988 Japan .

*Primary Examiner*—Fred L. Braun
*Attorney, Agent, or Firm*—Burns, Doane, Swecker & Mathis

[57] ABSTRACT

A developing apparatus is arranged to supply toner onto the surface of a developing sleeve to form on it, a thin layer of toner triboelectrically charged by a restricting member, and to feed the toner layer onto an electrostatic latent image holding member having an electrostatic latent image formed on it for developing the latent image. At least part or all of the surface layer of the developing sleeve is formed by a mixed material mainly composed of crystalline polyamide resin and non-crystalline polyamide resin.

8 Claims, 3 Drawing Sheets

DEVELOPING APPARATUS

BACKGROUND OF THE INVENTION

The present invention generally relates to a developing apparatus for use in electrophotography, and more particularly, to a developing apparatus which is arranged to develop an electrostatic latent image to be formed in electrophotography, electrostatic recording or the like through employment of one or mono-component developer, thereby to obtain a visible image.

Conventionally, there have been proposed many methods for the image formation based on the electrophotography as disclosed, for example, in U.S. Pat. No. 2297691 and Japanese Patent Publication Tokkosho No. 43-24748. Generally, such method is so arranged that, by forming an electrostatic latent image on a photosensitive member or photoreceptor having a photoconductive layer formed thereon, such latent image is subsequently developed through employment of toner, and a toner image thus obtained is transferred onto a transfer material such as a copy paper sheet or the like for fixing.

Meanwhile, various methods have also been conventionally proposed for visualizing the electrostatic latent image by the use of toner, among which particularly, the magnetic brush method, cascade method, and liquid developing method etc. which utilize the developing material mainly composed of toner and carrier are widely put into practical applications. Although favorable images may be obtained comparatively stably by any of the above methods, there are common problems related to two or dual-component developing material such as deterioration of toner, and variation of mixing ratio of toner to carrier, etc.

In order to overcome such problems, there have also been proposed various methods using the mono-component developing material composed only of toner.

In one of such mono-component developing methods as disclosed for example, in Japanese Patent Laid-Open Publication Tokkaisho No. 54-43036, it is so arranged that magnetic toner is triboelectrically charged, and applied over a developing sleeve in a very thin layer of toner, which is brought close to an electrostatic latent image so as to confront said latent image without contact therewith, thereby to effect developing under the action of the magnetic field.

By the above known method, favorable images may be obtained by the facts that a sufficient triboelectric charging is available, since the developing sleeve and the toner contact each other more closely by applying the magnetic toner onto the developing sleeve in the extremely thin layer, that the developing sleeve and toner are fully rubbed against each other, while coagulation among toner particles is intended to be solved by relatively moving the magnet and toner, with the toner supported by the magnetic force, and that ground fogging is prevented through development by causing the toner supported by the magnetic force to confront the electrostatic latent image for the developing, without contact therewith.

However, in the conventional practice as described above, the applicability of toner over the surface of the developing sleeve is readily affected depending on environmental conditions, and the toner is not sufficiently stirred, especially with a very small amount of displacement in the widthwise direction on the sleeve, and thus, various problems are brought about thereby.

For example, if fluidity of toner is lowered at high humidity or high temperature, coagulation of the toner can not be fully solved by the magnetic force, thus resulting in the lowering of the image quality and image density.

Meanwhile, during a period at low humidity, since the toner that is highly triboelectrically charged strongly adheres onto the developing sleeve, the toner layer over the sleeve becomes uneven when the sleeve is repeatedly rotated, thus also adversely affecting the image quality.

Moreover, when many sheets of original documents having image portions deviated in position, are copied or printed continuously, at portions not used at all for the developing, image density is undesirably lowered when the copying or printing is subsequently effected.

Furthermore, there are such problems that cost for the apparatus is increased by the employment of the magnet, and that clear color toner can not be used due to adoption of the magnetic toner.

Accordingly, as a method for solving the problem as described above, there has also been conventionally proposed a developing method which employs a non-magnetic mono-component toner.

The known developing method as described above is so arranged that, for example, as shown in FIG. 5, restricting members 81 are pressed against a cylindrical toner holding member 82 made of an elastic roller, and with toner T in a tank C being supplied to a nip portion N between said restricting members 81 and the toner holding member 82, said toner holding member 82 is driven for rotation in a direction indicated by an arrow A, whereby a thin and uniform toner layer is formed on the toner holding member 82, while the toner T is being triboelectrically charged by being rubbed at the nip portion N, and said toner layer is transported onto a photoreceptor PC, and by impressing a developing bias V onto the toner holding member 82, the electrostatic latent image on the photoreceptor PC is developed into a visible image.

In the above conventional developing method, since the toner T is charged through friction with respect to the toner holding member 82 and the restricting members 81, triboelectric charging characteristics of the toner holding member 82 and the restricting members 81 become important. If the toner holding member 82 is made of a metallic material, since its width in the frictional charging row is small and range (width for selection of triboelectric charging polarity thereof is also small, its difference in polarity with respect to the toner T can not be increased, and therefore, the toner has a wide charging distribution, while toner in the opposite polarity is produced, with consequent deterioration in the toner charging quality, and thus, fogging is formed in the copy or print images so as not to provide clear and definite images.

Additionally, in the above known practice, there has been proposed means for improvement such as plating of various kinds of metal on the surface of the toner holding member 82. By such a practice, however, not only cost is increased by that extent, but the range of selection for the triboelectrical charging polarity is undesirably narrowed.

Furthermore, for the developing, when a developing bias which will form alternating field at the developing region is impressed, the toner holding member 82 and the photoreceptor PC may be in the state of non-contact, but in the case where the electric field at the developing region is of a d.c. field, the toner holding member 82 and the photoreceptor PC are generally disposed in the state of contact. However, when they are held in contact with each other as described above, there are problems related to cylindricity and eccentricity of the toner holding member 82 or the photoreceptor PC, with large variations in the state of contact at the developing region, thus adversely affecting the image quality.

For solving the problem as described above, there has also been proposed a developing method in which the disadvantage inherent in the contact developing method as described above has been eliminated, for example, in U.S. Pat. No. 4,791,882.

More specifically, as shown in FIG. 6, the developing apparatus for effecting the above known developing method includes a driving roller 1 to be driven for rotation in a direction of an arrow b by a driving means (not shown), a cylindrical thin film developing sleeve 2 having a circumferential length longer than that of the driving roller 1 and loosely mounted around the driving roller 1, a guide member 3 which contacts opposite end portions of the driving roller 1 through said developing sleeve 2 so as to form a space S between the driving roller 1 and the developing sleeve 2 at a position where said driving roller 1 confronts an electrostatic latent image holding member PC arranged t be rotated in a direction indicated by an arrow a, and also to bring an outer surface of the developing sleeve 2 covering said space S into close contact with an outer peripheral face of said electrostatic latent image holding member PC at a developing region X, a blade or toner restricting member 4 pressed against the outer surface of said developing sleeve 2 contacting the driving roller 1 for forming a thin layer of charged toner over the outer peripheral face of said developing sleeve 2 rotating together with said driving roller 1, and a developing tank C accommodating therein said driving roller 1, developing sleeve 2, guide member 3, and toner restricting member 4 and containing therein a certain amount of toner T, with an agitator 5 being further provided within said developing tank C for rotation in a direction indicated by an arrow for prevention of blocking of the toner T.

However, in the various developing methods by the mono-component developing material as described so far, it is so arranged that the toner particles are triboelectrically charged by friction, etc. with respect to the toner holding member and the developing sleeve or the toner restricting member, and the developing is effected by contacting said tone particles with the electrostatic latent image holding member or in the state of non-contact of the toner particles therewith. In these methods, there is such a problem that the number of times for contacts between the toner particles and the tribo-electrical charging member is small, and the triboelectric charging tends to become insufficient. Moreover, since the restricting member is held in contact with the toner holding member under a pressure larger than a certain degree, there are also such disadvantages that the toner in a fused state adheres to the restricting member and the surface of the toner holding member is abraded, and/or filming of the toner takes place on the toner holding member, thus not providing a sufficient toner charging amount, without formation of a uniform thin layer of the toner as desired.

Accordingly, in the case where the electrical latent image is to be developed through utilization of the triboelectric charging by the use of the mono-component insulative toner, the surface characteristic of the triboelectric charging member such as the toner holding member is extremely important, and as one factor, the frictional force and affinity between the toner and the triboelectric charging member determines the stable charging characteristic of toner. In other words, if the coefficient of friction on the surface of the triboelectric charging member is too small, toner tends to slip at the toner restricting portion, resulting in a thin and uneven application, while on the contrary, if such coefficient of friction is too large, the applied toner layer becomes excessively thick, thus making it difficult to impart a sufficient triboelectric charge to the toner.

In connection with the above, although it is considered to employ a resin material for the triboelectric charging member from the aspects of the triboelectric charging characteristics, image quality and cost, etc., there still remain such problems as the tendency to fusion of toner onto the surface of the toner restricting member or toner holding member, and also, abrasion on the surface of the toner holding member.

SUMMARY OF THE INVENTION

Accordingly, an essential object of the present invention is to provide a developing apparatus which is so arranged to supply toner onto the surface of a toner holding member to form thereon a thin layer of toner triboelectrically charged by a restricting member, and to feed said toner layer onto an electrostatic latent image holding member having an electrostatic latent image formed thereon for developing said latent image, and in which a uniform mono-component insulative toner thin layer and a sufficient toner charge amount are available for effecting a favorable developing of the electrostatic latent image, while fusion of toner onto the surface of the toner holding member, and filming, etc. do not readily take place, with less abrasion on the surface of said toner holding member.

Another object of the present invention is to provide a developing apparatus of the above described type, which is simple in construction and stable in functioning at high reliability, and can be readily incorporated into electrophotographic copying machines and the like at low cost.

In accomplishing these and other objects, according to the present invention, there is provided a developing apparatus arranged to supply toner onto the surface of a toner holding member to form thereon a thin layer of toner triboelectrically charged by a restricting member, and to feed said toner layer onto an electrostatic latent image holding member having an electrostatic latent image formed thereon for developing the latent image, and characterized in that at least part or all of the surface layer of said toner holding member is formed by a mixed material mainly composed of crystalline polyamide resin and non-crystalline polyamide resin.

For the above toner holding member, there may be considered a structure in which, for example, a thin and uniform layer of polyamide resin is provided on a substrate of metal or the like, another structure in the form of a thin film developing sleeve or endless belt disclosed, for example, in U.S. Pat. No. 4,791,822 referred to earlier, and constructed through employment of polyamide resin, and further, a construction in which a film of polyamide resin is coated on an elastic roller, etc. In any of such structures, it is important that said polyamide resin is made of a mixed material mainly composed of crystalline polyamide resin and non-crystalline polyamide resin. For the crystalline polyamide resin, polyamide resins commercially available in general such as nylon 6, nylon 66, nylon 610, nylon 11, nylon 12, etc. may be employed, but from the viewpoint that a material not readily affected by environmental conditions as far as possible is preferable, nylon 12 with a low water absorption is particularly recommended.

It should be noted here that the word "polyamide" referred to in the present invention generally represents the resin prepared through condensation polymerization by forming amide bond between carboxylic acid and amino group, and that the word "crystalline polyamide" denotes polyamide having both crystalline structure of polymer chain and non-crystalline portion therein, and provided with two denaturation points for the glass transition point and melting point as viewed from thermal physical property, and indicating values for crystallinity in the range of 10 to 30% when measured for the degree of crystallization by X-ray analysis, and analyzed by Rowland method.

For the crystalline polyamide, although nylon 12 with a low water absorption is preferable as described earlier, GRILAMID L 25 (name used intrade and manufactured by Mitsubishi Chemical Industries Ltd., Japan), etc. may be raised as one example. Moreover, UBE nylon 66 (name used in trade and manufactured by Ube Kosan Industries, Ltd., Japan) can be favorably utilized.

Meanwhile, the word "non-crystalline polyamide" represents polyamide which substantially has no crystalline structure of polymer chain therein, and lacks in the melting point, although having the glass transition point, even when observed from the viewpoint of thermal physical property. Even if the above polyamide is measured for crystallinity by the X-ray analysis, and analyzed by Rowland method, it shows the crystallinity of only about 0% (and 1 to 2%).

For specific non-crystalline polyamide, it is desirable to select a material in which diamine group constituting nylon has a side chain or dicarboxylic acid is of aromatic iso type selected for condensation polymerization. For such non-crystalline polyamide, GRILAMID TR 55 and NOVAMID X 21 (names used in trade and manufactured by Mitsubishi Chemical Ltd., Japan) can be raised as examples.

As a method for applying a mixed resin of crystalline polyamide resin and non-crystalline polyamide resin onto a substrate of a metallic material and the like, there may be employed a conventional applying means in which the metallic substrate is immersed in a solution prepared by mixing a solution of the mixed resin of said crystalline polyamide resin and non-crystalline polyamide resin, with solvents composed of acids such as acetic acids, phenol, etc., lower alcohol such as methanol, ethanol, propanol, butanol, etc., or halogenated hydrocarbon such as chloroform, trichlene, etc., or a small amount of water, esters, and aromatic hydrocarbon. By such applying means, a coating film having a sufficient strength and flexibility may be uniformly formed by said mixed resin referred to above.

Furthermore, for the purpose of improving various physical properties such as the bonding characteristic between the substrate and the mixed resin, the applicability of the mixed resin onto the substrate, and durability of the mixed resin, etc., and other purposes, there may be added other proper high polymers, assistant agents for electrical conduction such as carbon black, metallic powder, etc., reinforcing materials such as glass fibers, stainless steel, filaments, or charge control agents such as pigments, etc., to said mixed resin in a range not reducing its effects.

When the toner holding member is to be formed into the shape of said thin film developing sleeve or an endless belt, it may be formed for example, by charging the crystalline polyamide resin and non-crystalline polyamide resin into an ordinary extrusion molding machine, thereby to prepare the mixed resin composed of such resins in said molding machine for subsequent molding thereof through extrusion.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
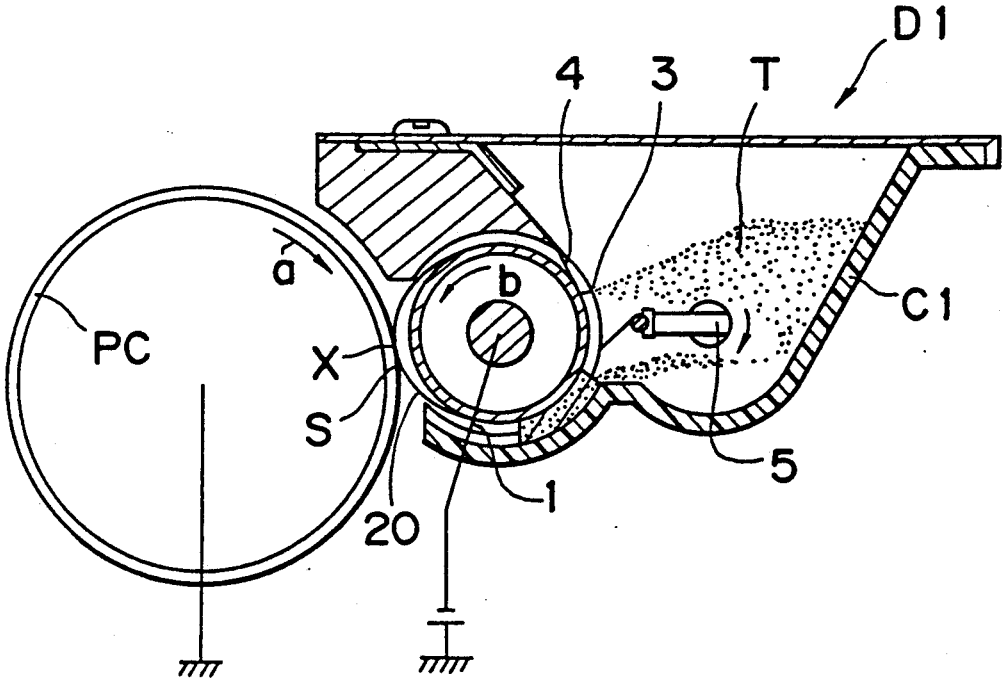
FIG. 1 is a schematic side sectional view of a developing apparatus according to one preferred embodiment of the present invention.

Before the description of the present invention proceeds, it is to be noted that like parts are designated by like reference numerals throughout the accompanying drawings.

Referring now to the drawings, there is shown in FIG. 1, a developing apparatus D1 according to one preferred embodiment of the present invention.

Figure 6:
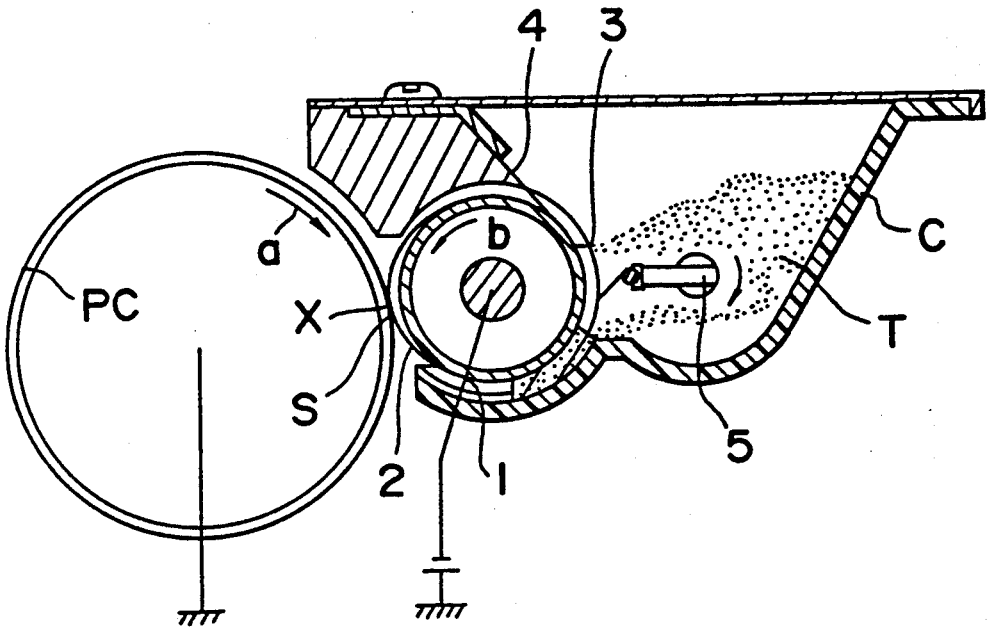
Fig. 6 PRIOR ART
FIG. 6 is view similar to FIG. 1, which particularly shows another prior art developing apparatus (already referred to).

It is to be noted here that the developing apparatus D1 of the present invention as shown in FIG. 1 has the construction similar to that of the conventional developing apparatus described earlier with reference to FIG. 6 except that the developing sleeve 2 as the toner holding member in the prior art developing apparatus of FIG. 6 has been replaced by a developing sleeve 20 constituted by a mixed resin of crystalline polyamide resin and non-crystalline polyamide resin. Therefore, detailed description of the construction for the developing apparatus D1 of FIG. 1 except for the developing sleeve 20 has been abbreviated here for brevity of explanation, with like parts being designated by like reference numerals.

In FIG. 1, the developing sleeve 20 directly related to the present invention is prepared in such a manner that the mixed resin in which non-crystalline polyamide resin TR 55 (referred to earlier) is added, at 50% by weight, to crystalline polyamide resin L25 (referred to earlier) is molded into a cylindrical shape with an outer diameter of 25 mm and thickness of 150 μm through extrusion molding method, and thereafter, formed on its surface, with fine concave and convex portions in a range of 2 to 3 μm by sand-blast treatment.

By the developing apparatus D1 according to the present invention, as the driving roller 1 is rotated, the developing sleeve 20 is also rotated in the direction indicated by an arrow b through frictional force with respect to said driving roller 1, and the mono-component insulative toner T (to be negatively charged in this embodiment) contained in the developing tank C1 is fed onto the developing sleeve 20 through rotation of the agitator 5 in the direction indicated by an arrow, while the toner T thus fed is fully charged by the toner restricting blade 4, and adheres onto the surface of the developing sleeve 20 in a predetermined uniform thin layer so as to be transported to a developing region X, where said toner T is used for the development of an electrostatic latent image formed o the electrostatic latent image holding member PC (in the form of the photoreceptor drum in the present embodiment). In the above, the blade 4 presses the thin toner layer against the surface of the sleeve 20 by predetermied force.

In the construction as in the developing apparatus D1 for the above embodiment, the shape of slackening or loosening of the developing sleeve 20 at its portion contacting the latent image holding member PC is undesirably varied in the axial direction depending on the degree of rigidity, etc. of the developing sleeve film. Therefore, in order to make the slackening shape constant in the axial direction, rigidity of the film larger than a certain level becomes necessary.

According to experiments, it has been confirmed that the mixing ratio of the crystalline polyamide resin to the non-crystalline polyamide resin has influence on the film rigidity, and for use in the arrangement according to the present invention, a uniform contact state may be achieved when a mixed resin to which the non-crystalline polyamide resin is added at 40 to 65% by weight ratio is employed. If the amount of addition of the non-crystalline polyamide resin is less than the above, sufficient rigidity of the film can not be obtained, and therefore, the uniform contact between the developing sleeve 20 and the latent image holding member PC is not available. On the contrary, when the amount of addition thereof becomes larger than that, the sleeve film itself tends to become brittle, and cracks are undesirably formed when used for the arrangement of the present invention.

Moreover, the amount of addition of the non-crystalline polyamide resin also relates to the surface hardness of the sleeve film formed, and the surface hardness becomes high as the amount of addition thereof increases. The surface hardness is associated with transportability of the toner, and according to the experiments carried out by the present inventors, surface hardness higher than a grade HB is required in the measurement taken by a pencil hardness tester. Through addition of the non-crystalline polyamide resin by more than 40%, the surface hardness higher than the grade HB may be obtained, while, by the amount of addition less than that, such surface hardness can not be obtained. By this reason, the amount of addition of the non-crystalline polyamide resin should preferably be higher than 40%.

Meanwhile, with respect to the problem related to the uniform contact with the latent image holding member PC and stable driving of the developing sleeve, the film thickness of the developing sleeve is an important factor, and in the arrangement as in the present embodiment, the developing sleeve film thickness should preferably be in the range of 70 to 250 μm. If the film thickness becomes smaller than that, it is difficult to stably form the constant slackened portion at all times, while, when the film thickness becomes larger than the above, slippage takes place due to increase of the rigidity of the film itself, thus making it impossible to achieve stable driving.

Figure 2:
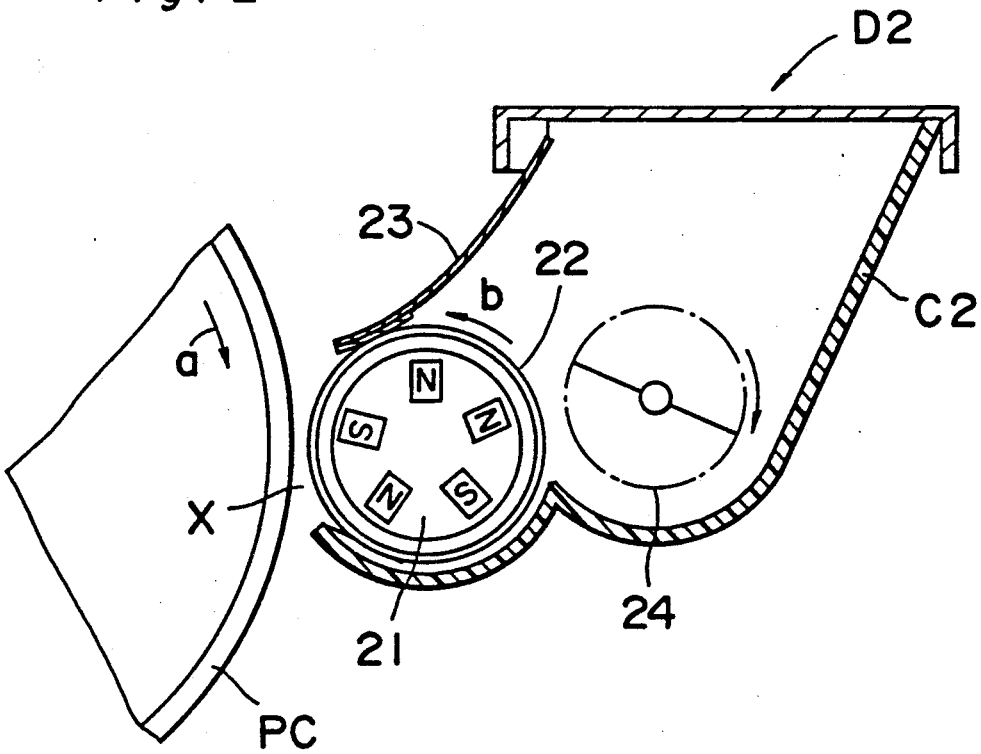
FIG. 2 is a schematic side sectional view of a developing apparatus according to another embodiment of the present invention.

Referring further to FIG. 2, there is shown a developing apparatus D2 according to another embodiment of the present invention, which generally includes a stationary magnet roller 21 provided with magnetic poles, a developing sleeve 22 externally provided on the magnet roller 21, a toner restricting member 23 pressed, at its one end, against said developing sleeve 22 for forming thin toner layer onto the surface of the sleeve 22, an agitating member 24 rotatably provided behind the developing sleeve 22 for supplying mono-component insulative magnetic toner onto the developing sleeve 22, which confronts the photoreceptor drum PC, and a developing tank C2 accommodating the above members and containing a certain amount of toner (not particularly shown) therein.

The above developing sleeve 22 is prepared in such a manner that a mixed resin in which non-crystalline polyamide resin NOVAMID X 21 (referred to earlier) is added to the same crystalline polyamide resin as that used in the embodiment of FIG. 1 at 50% by weight ratio, is dissolved into methyl alcohol to obtain a 5% solution, and in this solution, a sleeve of aluminum of 25 mm in diameter is immersed for subsequent rasing and drying, thereby to form a uniform coating film of about 10 μm thick on the surface of said aluminum sleeve.

In the above developing apparatus D2 in FIG. 2, the developing sleeve 22 is driven for rotation in the direction indicated by an arrow b by a driving means (not shown), while the mono-component insulative magnetic toner is supplied onto the developing sleeve 22 through rotation of the agitating member 24, and the toner thus supplied is fully charged as desired by the restricting member 23 and formed into a uniform thin layer of a predetermined thickness so as to be transported to the developing region X, where it is used for the development of the electrostatic latent image on the photoreceptor drum PC.

In the construction as in the developing apparatus D2 for the above embodiment, since the rigidity of the developing sleeve film is not required so much, and the surface hardness for the film becomes rather necessary, the amount of addition of the non-crystalline polyamide resin may favorably serve the purpose even in the range of 50 to 75% by weight ratio, and the film thickness in the range of 5 to 25 μm will stabilize the transportability and charging characteristic of toner, and provide uniform and good images for a long period, with favorable characteristics displayed.

Figure 3:
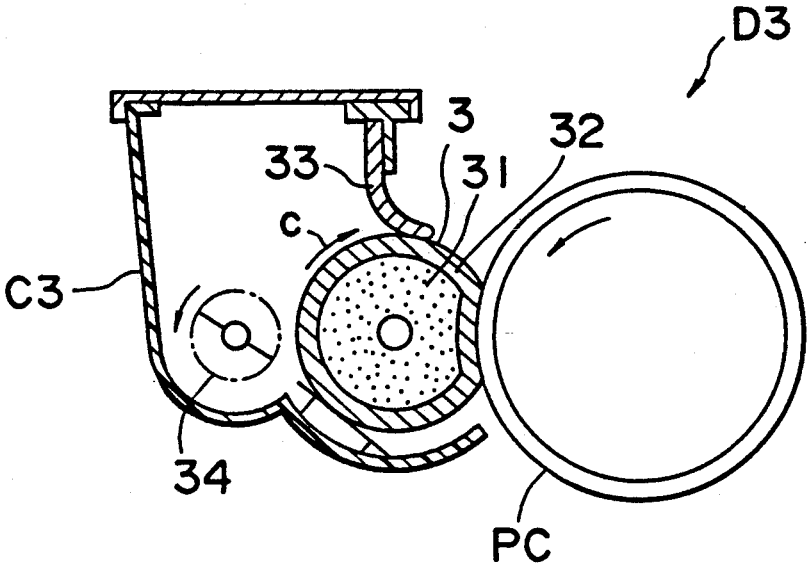
FIG. 3, is schematic side sectional view of a developing apparatus according to a further embodiment of the present invention.

Referring also to FIG. 3, there is shown a developing apparatus D3 according to a further embodiment of the present invention. This developing apparatus D3 generally includes a developing roller 3 as a toner holding member driven for rotation in the direction indicated by an arrow C by a driving means (not shown), a toner restricting member 33 pressed, as its one end, against said roller 3 thereby toner with layer is formed onto the surface of the roller, a rotary agitating member 34 rotatably provided behind the developing roller 3 for supplying mono-component insulative toner (not shown) onto said roller 3, and a developing tank C3 accommodating the above described members and containing a certain amount of toner (not particularly shown) therein, with the surface of said developing roller 3 contacting the surface of the photoreceptor drum PC as shown.

The developing roller 3 referred to above is constituted by an elastic or resilient roller 31 and a film layer 32 coated on the surface of said elastic roller 31. The film layer 32 is formed by a mixed resin in which the same non-crystalline polyamide resin as used in the embodiment of FIG. 1 is added to the same crystalline polyamide resin as used in the embodiment of FIG. 1 at 50% by weight ratio so as to be about 100 μm in thickness. In the arrangement as in the present invention, elasticity as the developing roller on the whole is required, and the film thickness in the range of 30 to 150 μm is preferable, with the addition amount of the non-crystalline polyamide in the range of 40 to 65%.

In the above developing apparatus D3 also, the toner supplied onto the developing roller 3 is fully charged into the desired state by the action of the toner restricting member 33, and transported to the developing region in the form of a uniform thin layer of a predetermined thickness so as to be used for the development of the electrostatic latent image on the photoreceptor drum PC.

Figure 4:
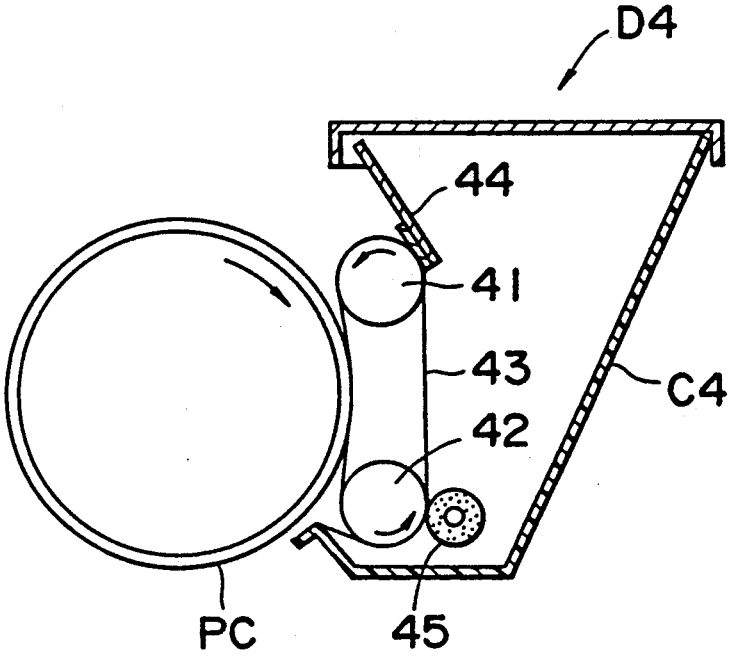
FIG. 4 is a schematic side sectional view of a developing apparatus according to a still further embodiment of the present invention.
Figure 5:
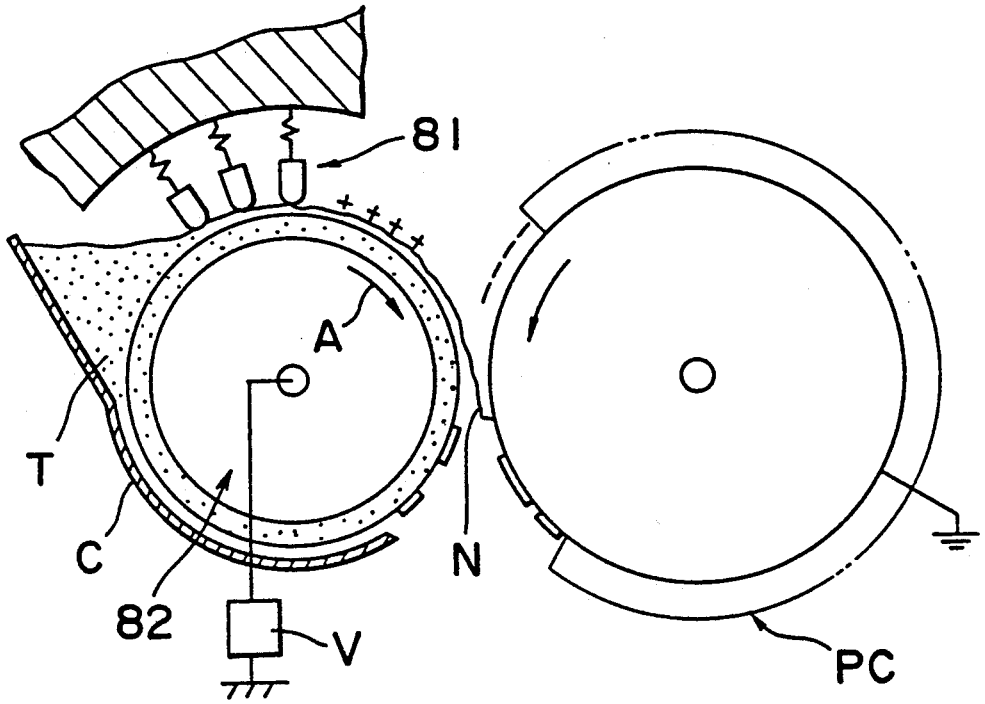
Fig. 5 PRIOR ART
FIG. 5 is a view similar to FIG. 1, which particularly shows a prior art developing apparatus (already referred to)

Reference is further made to FIG. 4 showing a developing apparatus D4 according to a further embodiment of the present invention.

The developing apparatus D4 in FIG. 4 generally includes a developing belt 43 in the form of an endless belt passed around a set of spaced pulleys 41 and 42 rotatably provided, a restricting member 44 pressed, at its one end, against said belt 43, a toner supplying rotary member 45 rotatably provided at the lower portion of the developing belt 43 and adapted to supply mono-component insulative toner (not shown) onto the developing belt 43, and a developing tank C4 accommodating the above members and a certain amount of toner (not particularly shown) therein, with the developing belt 43 contacting the photoreceptor drum PC as shown.

The developing belt 43 is formed, through extrusion by an extrusion molding machine, a mixed resin in which the same non-crystalline polyamide resin as used in the embodiment of FIG. 1 is added to the same crystalline polyamide resin as used in the embodiment of FIG. 1, at 50% by weight ratio, so as to be 200 μm in thickness, with very small concave and convex portions in the range of 2 to 7 μm being formed on the surface by blast treatment.

In the arrangement as in the above embodiment of FIG. 4, tensile strength of the belt film becomes rather important, and the amount of addition of the non-crystalline polyamide resin should preferably be in the range of 40 to 65%, with the film thickness of the belt being in the range of 100 to 500 μm.

In the above developing apparatus D4 also, the mono-component insulative toner supplied onto the developing belt 43 is fully charged into the desired state by the action of the restricting member 44, and transported to the developing region in the form of a uniform thin layer of a predetermined thickness so as to be used for the development of the electrostatic latent image on the photoreceptor drum PC.

According to the respective developing apparatuses D1 to D4 of the present invention as described so far, since the surfaces of the toner transporting and holding members 20,22,3 and 43 are formed by the mixed resin of the crystalline polyamide resin and the non-crystalline polyamide resin, the surface hardness and film rigidity thereof are set to be proper, and consequently, toner sticking to the restricting members and toner holding members, etc. or formation of filming and the like may be advantageously prevented, while, owing to the fact that the surface abrasion of the toner holding members is suppressed, the amount of toner to be transported is stabilized at all times, thereby to provide images at high quality for a long period.

For a comparative experiment, another developing apparatus having the similar constructions and film thickness to those of the developing apparatus D1 of FIG. 1 is prepared except that the developing sleeve thereof is composed only of the crystalline polyamide GRILAMID L 25 (referred to earlier), and comparative developments were effected.

As a result, although the surface hardness of the developing sleeve 20 for the developing apparatus D1 in FIG. 1 was above the grade HB as described earlier, that of the developing sleeve in the comparative experiment was reduced to a grade about 2B. Moreover, in the case of the developing apparatus D1 in FIG. 1, there was no inconvenience found even when the development of 2,000 times was effected, but in the case of the developing apparatus for the comparative experiment, the toner gradually adheres to and accumulated on the restricting blade as the developing proceeds, and at the time point when the development of 2,000 times was effected, stripe-like noises were observed on the developed image.

Meanwhile, still another developing apparatus was prepared for the comparative experiment, in which the developing sleeve in the developing apparatus in FIG. 1 was prepared only by the non-crystalline polyamide GRILAMID TR 55 (referred to earlier). In this case, however, the film became brittle to form cracks, and a proper developing sleeve could not be prepared thereby. The result was the same in the developing apparatuses D2 to D4 in FIGS. 2 to 4, and it was impossible to form the material into the belt or sleeve configuration only by the non-crystalline polyamide.

Moreover, since polyamide resin is used, the toner T may be highly charged negatively, and it becomes possible to achieve rapid rising of toner charge.

Although the relation between the surface hardness of the toner holding member and the sticking of toner to the restricting member is not fully clarified, it may be considered as follows.

For the restriction of contact by the restricting member, the toner restricting amount and toner charge amount are important factors, and normally, the restriction is effected by applying pressure higher than a certain level. Therefore, the toner is molten due to generation of frictional heat, etc. and adheres and sticks to a portion in the vicinity of the restricting portion of the restricting member. If such state is continued for a long period of time, the sticking of toner expands as far as the restricting portion, and thus, it becomes impossible to obtain uniform toner thin layer and charging characteristics. However, if the surface hardness of the toner holding member is high, the toner sticking at the restricting portion of the restricting member is to be polished, and consequently, growth of toner sticking is stopped. Meanwhile, if the surface hardness of the toner holding member is low (below the grade HB according to the experiment by the present inventors), such polishing effect is not sufficient, and the toner sticking continues to grow.

Additionally, if the surface hardness or film rigidity of the toner holding member is low, the forward edge of the restricting portion for the restricting member undesirably sinks into the toner holding member, with the result that the shape of a delta portion formed by the restricting member and the surface of the toner holding member is altered so as to show a state in which the toner will adhere more easily.

As is clear from the foregoing description, according to the present invention, it becomes possible to provide the developing apparatus which is arranged to supply toner onto the surface of the toner holding member to form thereon the thin layer of toner triboelecrically charged by the restricting member, and to feed said toner layer onto the electrostatic latent image holding member having an electrostatic latent image formed thereon for developing said latent image, and in which the uniform mono-component insulative toner thin layer and the sufficient toner charge amount are available for effecting a favorable developing of the electrostatic latent image, while fusion of toner onto the surface of the toner holding member, and filming etc. do not readily take place, with less abrasion on the surface of said toner holding member.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A developing apparatus for use in electrophotography, which comprises a toner holding member having a surface and holding toner on the surface and adapted to be driven for rotation, the surface of said toner holding member containing a mixture mainly composed of crystalline polyamide and non-crystalline polyamide, means for supplying toner onto the surface of said toner holding member, and a restricting member for restricting a layer of toner on said surface by depressing the toner thus supplied onto the surface of said toner holding member.

2. A developing apparatus for developing an electrostatic latent image on an image holding member, comprising:

a toner holding member having a surface and being mounted in contact with a surface of said image holding member, said toner holding member having toner on its surface and being driven for rotation, the surface of said toner holding member containing a mixture mainly composed of crystalline polyamide and non-crystalline polyamide, said non-crystalline polyamide being contained in an amount at 40 to 65% by weight with respect to said toner holding member, means for supplying toner onto the surface of said toner holding member, and a restricting member for restricting a layer of toner by depressing the supplied toner onto the surface of said toner holding member.

3. A developing apparatus as claimed in claim 2, wherein said toner holding member further includes a roller driven for rotation, a thin film member provided on an outer peripheral face of said roller and having a circumferential length slightly longer than that of the outer peripheral face of said roller, said thin film member composed of the mixture of said crystalline polyamide and non-crystalline polyamide having film thickness in a range of 70 to 250 μm, and means for depressing said thin film member onto said roller to form a slackened portion so as to contact said slackened portion with the surface of said image holding member.

4. A developing apparatus as claimed in claim 2, wherein said toner holding member further includes a roller made of an elastic material and driven for rotation, and a thin film member covering an outer peripheral face of said roller and adapted to contact the surface of said image holding member, said thin film member being composed of the mixture of the crystalline polyamide and non-crystalline polyamide and having film thickness in a range of 30 to 150 μm.

5. A developing apparatus as claimed in claim 2, wherein said toner holding member further includes a pair of rollers, at least one of which is driven for rotation, and a thin film member composed of the mixture of the crystalline amide and non-crystalline amide passed between said rollers, said thin film member contacting the surface of said image holding member, and having film thickness in the range of 100 to 500 μm.

6. A developing apparatus as claimed in claim 5, wherein the surface of said thin film member is subjected to roughening treatment.

7. A developing apparatus for developing an electrostatic latent image on an image holding member, which comprises:

a toner holding member having a surface and being provided in contact with a surface of said image holding member at a predetermined region, said toner holding member having toner on its surface and is driven for rotation, the surface of said toner holding member containing a mixture mainly composed of crystalline polyamide and non-crystalline polyamide, said non-crystalline polyamide being contained in amount at 50 to 75% by weight with respect to said toner holding member, means for supplying toner onto the surface of said toner holding member, and a restricting member for restricting a layer of toner by depressing the supplied toner onto the surface of said toner holding member.

8. A developing apparatus as claimed in claim 7, wherein said toner holding member further includes a roller made of a rigid material and driven for rotation, and a thin film member covering an outer peripheral face of said roller and composed of the mixture of the crystalline polyamide and non-crystalline polyamide, said thin film member having film thickness in a range of 5 to 25 μm.

* * * * *